US007770297B1

(12) United States Patent
Sommerfeld

(10) Patent No.: US 7,770,297 B1
(45) Date of Patent: Aug. 10, 2010

(54) ELECTRONICALLY ACTUATED FIRST-DOWN MARKING SYSTEM AND ASSOCIATED METHOD

(76) Inventor: Myron Sommerfeld, 4454 Casitas St., San Diego, CA (US) 92107

( * ) Notice: Subject to any disclaimer, the term of this patent is extended or adjusted under 35 U.S.C. 154(b) by 889 days.

(21) Appl. No.: 11/649,490

(22) Filed: Jan. 4, 2007

Related U.S. Application Data

(60) Provisional application No. 60/757,531, filed on Jan. 10, 2006.

(51) Int. Cl.
*G01C 15/00* (2006.01)

(52) U.S. Cl. ..... 33/289; 33/DIG. 21

(58) Field of Classification Search ..... 33/289, 33/227, 263, 286, 281, 282, DIG. 21
See application file for complete search history.

(56) References Cited

U.S. PATENT DOCUMENTS

| | | | | |
|---|---|---|---|---|
| 3,985,356 | A | 10/1976 | Carlock | |
| 4,090,708 | A | 5/1978 | McPeak | |
| 5,189,803 | A * | 3/1993 | Caywood | 33/289 |
| 6,778,283 | B2 | 8/2004 | Lee et al. | |
| 6,851,198 | B1 * | 2/2005 | Harty | 33/289 |
| 6,907,840 | B1 * | 6/2005 | Gaines | 33/289 |
| 6,976,928 | B2 * | 12/2005 | Hemphill | 33/289 |
| 7,185,439 | B1 * | 3/2007 | Nubin et al. | 33/289 |
| 7,481,003 | B2 * | 1/2009 | Garza | 33/289 |
| 2008/0034598 | A1 * | 2/2008 | Boccardi | 33/289 |
| 2008/0256811 | A1 * | 10/2008 | Garza | 33/289 |

* cited by examiner

*Primary Examiner*—Yaritza Guadalupe-McCall

(57) ABSTRACT

An electronically actuated first down marking system and associated method includes first and second marking assemblies positioned on a first sideline of a playing field, and third and fourth marking assemblies positioned on a second sideline of the playing field and opposite of the first and second marking assemblies. A mechanism determines a distance between the first and second marking assemblies, and a mechanism aligns the first and second marking assemblies with the third and fourth marking assemblies. The aligning mechanism and the distance determining mechanism are independently and simultaneously operable during game conditions. A mechanism determines whether a mobile game ball has penetrated a first down plane defined by the second and fourth identification marking assemblies.

9 Claims, 7 Drawing Sheets

ELECTRONICALLY ACTUATED FIRST-DOWN MARKING SYSTEM AND ASSOCIATED METHOD

CROSS REFERENCE TO RELATED APPLICATIONS

This application claims the benefit of U.S. Provisional Application No. 60/757,531, filed Jan. 10, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to electronic markers and, more particularly, to an electronically actuated first down marking system and associated method for use in sporting activities executed on a pre-defined playing field.

2. Prior Art

In the game of football, an offensive team that advances the ball the length of ten yards within four plays makes a first down and retains possession of the ball. The traditional method of measuring a first down or determining the distance yet to be covered to make a first down relies on a set of markers connected by a chain that stretches ten yards. The back marker pole, known as the scrimmage marker, designates the starting point from which to measure a first down. The forward marker pole, known as the first down marker, is stretched against the length of the chain and designates the length of the field over which the offensive team must carry the ball in order to make a first down.

Throughout the game, football officials must resort to the traditional first down markers kept on the sideline to establish whether the offensive team has carried the ball the required distance. In situations where the football is located in the middle of the field, which is 53 yards wide, the first down markers must be moved onto the field for the measurement causing the game to be stopped. This increases the time it takes to complete a game.

The current first down measuring method can be inaccurate. During play, the first down markers remain on the sideline with the scrimmage marker designating the position of the ball at the beginning of the previous first down. In moving the markers onto the field to obtain a measurement of the ball after the play has ended, errors are introduced by forward or backward shifts of the markers relative to their first down positions on the sideline. Since the difference between making a first down and not could be a fraction of an inch, any variation in the position of the first down markers on the field versus the first down markers on the sideline is critical. In addition, the current measuring method causes many delays in the play of the game.

One prior art example shows an apparatus for measuring the required distance necessary for a first down in the sport of football. The apparatus includes a ten yard marker pole with an attached laser apparatus. The laser apparatus emits light in the blue-green wavelength and is capable of emitting a laser beam across the entire width of the field onto a target, to aid an official in determining if a first down has occurred or not. Unfortunately, this prior art example does not include a laser system that uses red and green lasers to visually determine when a game ball has broken the plane measured at ten yards, thus indicating a first down has been achieved.

Another prior art example shows a football first down indicator system for providing a method of quickly and accurately determining a first down in football. The football first down indicator system includes a pair of first down marker members each having an elongate housing member, and also having a stub shaft being attached to a bottom of the elongate housing member for resting upon a ground, and further having a down display housing being attached to a top of the elongate housing member, and also includes a plurality of number display members being rotatably disposed in each down display housing, and further includes an assembly for determining and signaling a first down in football. Unfortunately, this prior art example does not incorporate the use of a pair of assemblies on each side of the playing field, each pair working with the opposite pair, to give the most accurate measurement possible.

Accordingly, a need remains for an electronically actuated first down marking system and associated method in order to overcome the above-noted shortcomings. The present invention satisfies such a need by providing a system that is convenient and easy to use, is lightweight yet durable in design, and accurately measures placement of a game ball on a playing field during sporting activities. Such a system incorporates the use of laser light to provide a simple and accurate measurement from either side of the playing field. The system measures independently from each sideline and can also be used in conjunction with the system on the opposite side. The system is simple to use and designed for many years of repeated use.

BRIEF SUMMARY OF THE INVENTION

In view of the foregoing background, it is therefore an object of the present invention to provide a system for an electronically actuated first down marking system and associated method. These and other objects, features, and advantages of the invention are provided by an electronically actuated first down marking system and associated method for use in sporting activities executed on a pre-defined playing field.

The system includes first and second identification marking assemblies removably positioned on a first sideline of a playing field, and third and fourth identification marking assemblies removably positioned on a second sideline of the playing field and oppositely seated of the first and second identification marking assemblies respectively. Such first, second, third and fourth identification marking assemblies are co-extensively shaped.

The system further includes a mechanism for determining a distance between the first and second identification marking assemblies such that a game official can accurately measure ten yards between the first and second identification marking assemblies. Such a distance determining mechanism advantageously includes a tuned frequency signal generating circuit housed within the first identification marking assembly, and a first transceiver electrically coupled to the tuned frequency signal generating circuit. Such a first transceiver effectively transmits a first output signal generated by the tuned frequency signal generating circuit. A sensor and a second transceiver are housed within the second identification marking assembly. Such a sensor is conveniently calibrated for effectively generating a second output signal when the first output signal is detected as an authorized signal that has a frequency within a pre-determined range. The second transceiver transmits the second output signal to the first transceiver.

The distance determining mechanism further includes a transducer, and a processor electrically coupled to the transducer. A memory is electrically coupled to the processor and includes software instructions for advantageously causing the first identification marking assembly to effectively determine whether the first and second identification marking assemblies are ten yards apart. Such software instructions execute a control logic algorithm including the steps of determining a total time interval lapsed between transmitting the first output signal to receiving the second output signal, multiplying the total time interval with the speed of light for obtaining a first value, comparing the first value with a second value wherein the second value equals ten yards, and if the first and second values are equal, causing the transducer to emit an audible signal for a pre-determined time period.

The system further includes a mechanism for effectively aligning the first and second identification marking assemblies with the third and fourth identification marking assemblies respectively such that the second and fourth identification marking assemblies and the first and third identification marking assemblies are horizontally disposed along a single plane and on opposite sides of the playing field. Such an aligning mechanism and the distance determining mechanism are independently and simultaneously operable during game conditions.

Such an aligning mechanism includes a first sensor housed within the first identification marking assembly, and a first laser housed within the first identification marking assembly and electrically coupled to the first sensor. A second sensor is housed within the third identification marking assembly. A second laser is also housed within the third identification marking assembly and electrically coupled to the second sensor. Such a first laser effectively transmits an output signal to the second sensor such that the second sensor conveniently instructs the second laser to transmit a response signal to the first sensor when the first and third identification marking assemblies are aligned along the plane.

The system further includes a mechanism for determining whether a mobile game ball has penetrated a first down plane effectively defined by the second and fourth identification marking assemblies such that the official easily determines whether a first down has been achieved. Such a game ball penetrating mechanism includes a controller housed within the second identification marking assembly that includes a processor. A logic gate and a memory are electrically coupled to the processor.

Such a memory includes software instructions that effectively cause the second and fourth identification marking assemblies to advantageously establish a green light therebetween when the game ball penetrates the plane defined between said second and fourth identification marking assemblies. Such software instructions execute a control logic algorithm including the steps of receiving first and second instruction signals from the distance determining mechanism and the alignment mechanism respectively, determining whether the alignment mechanism has been offset beyond a pre-determined time interval, and transmitting first and second output signals to the logic gate based upon data embedded within the first and second instruction signals. Such a logic gate generates a final output signal when the first and second output signals have true values such that the green light conveniently remains illuminated until the second and fourth identification marking assemblies are displaced from a rested position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
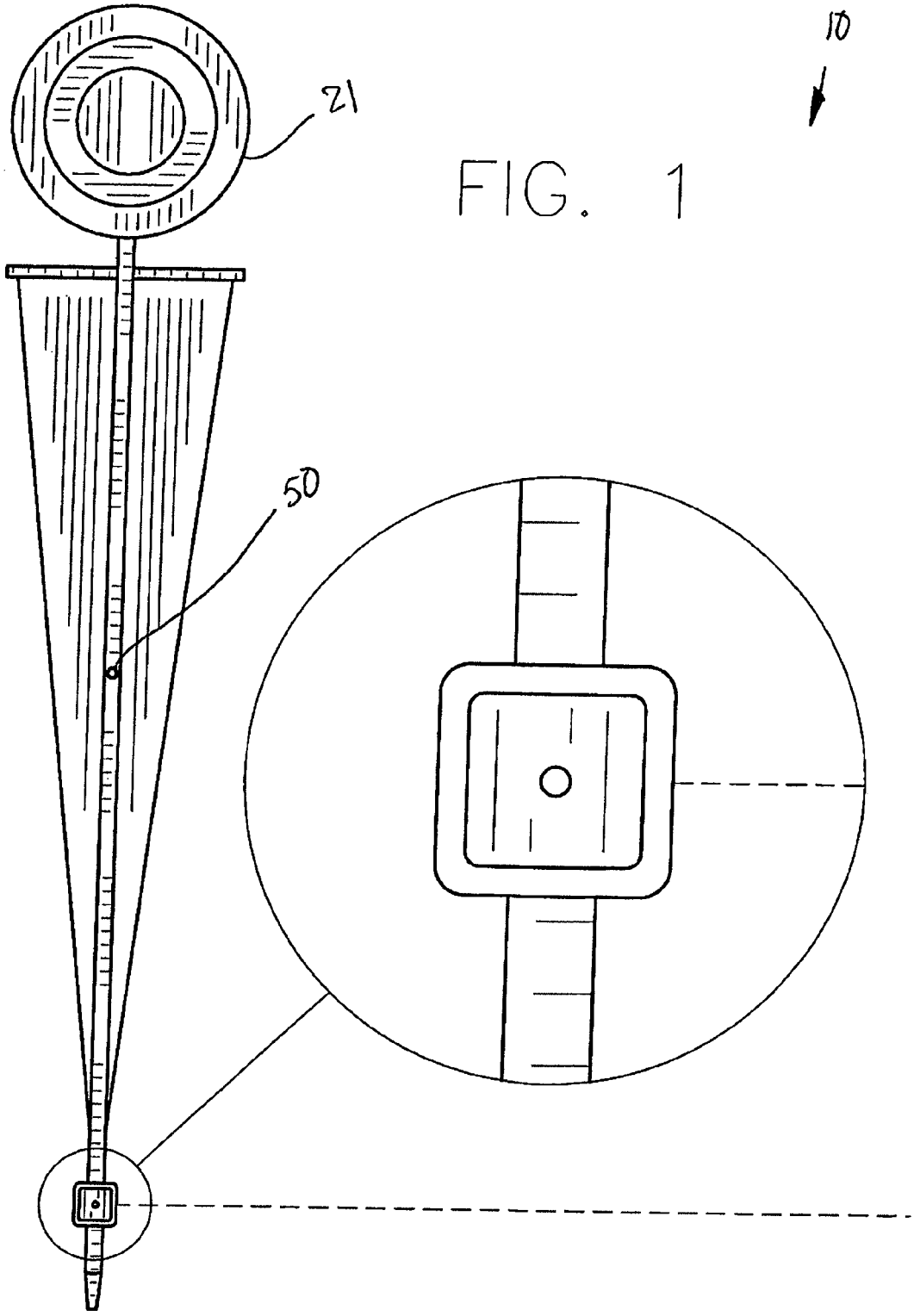
FIG. 1 is a side elevational and expanded view of a first down identification marking assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-7 by the reference numeral 10 and is intended to provide an electronically actuated first down marking system and associated method. It should be understood that the system 10 may be used to mark many different distances on many different types of playing fields and should not be limited in use to marking only those distances on those types of fields described herein.

Referring initially to FIGS. 3, 5, 6 and 7, the system 10 includes first 21 and second 22 identification marking assemblies removably positioned on a first sideline 11 of a playing field 12, and third 23 and fourth 24 identification marking assemblies removably positioned on a second sideline 13 of the playing field 12 and oppositely seated of the first and second identification marking assemblies 21, 22 respectively. Such first, second, third and fourth identification marking assemblies 21, 22, 23, 24 are co-extensively shaped. Further, such first, second, third and fourth assemblies 21, 22, 23, 24 are interchangeable in their positioning upon a playing field 12.

Figure 5:
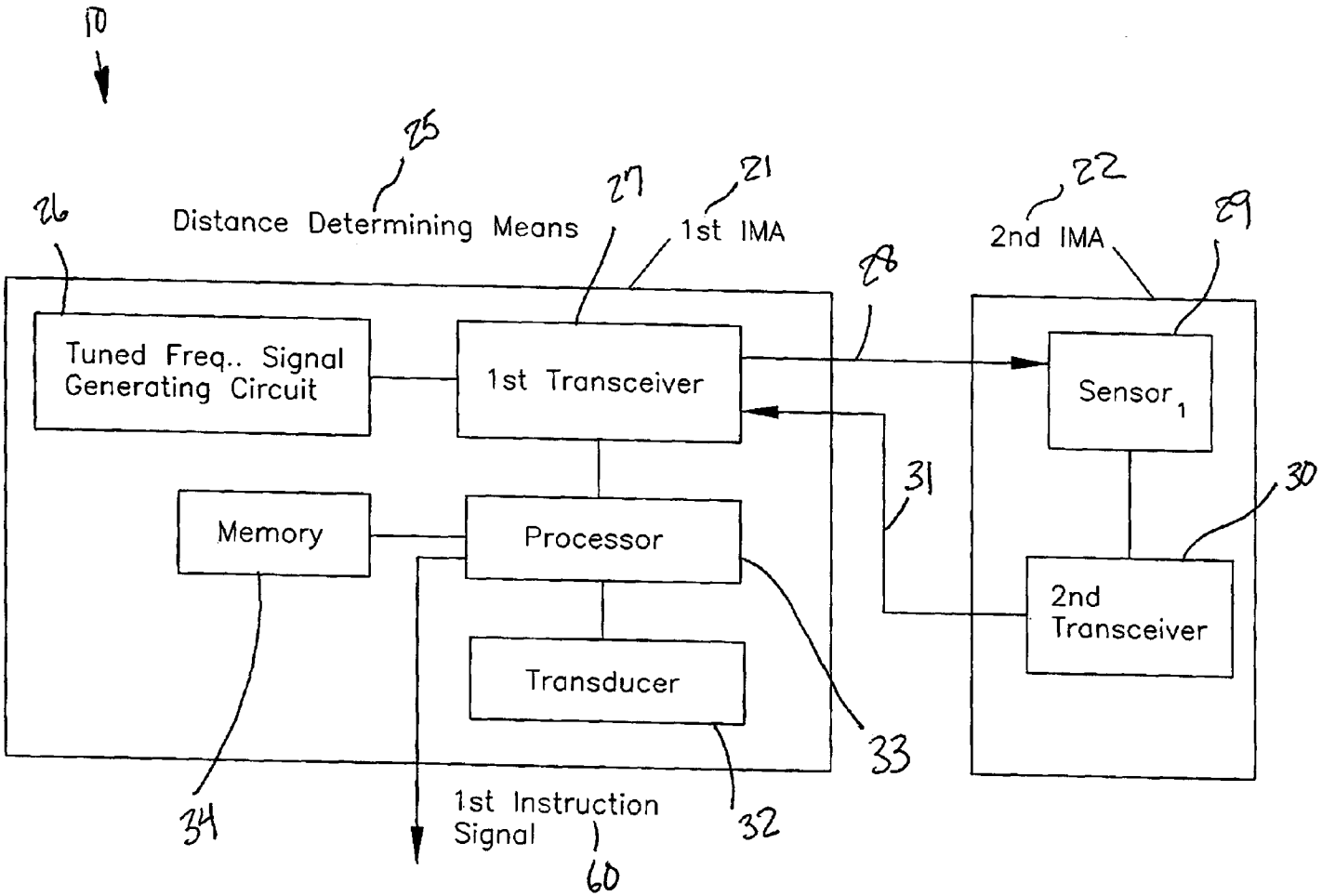
FIG. 5 is a schematic block diagram of the distance determining mechanism.

Referring to FIG. 5, the system 10 further includes a mechanism 25 for determining a distance between the first and second identification marking assemblies 21, 22 such that a game official can accurately measure ten yards between the first and second identification marking assemblies 21, 22. This mechanism 25 allows an official to indicate an initial game ball 14 placement and accurately measure the distance needed for the game ball 14 to move in order to gain a first down. Such a distance determining mechanism 25 includes a tuned frequency signal generating circuit 26 housed within the first identification marking assembly 21, and a first transceiver 27 electrically coupled to the tuned frequency signal generating circuit 26. Such a first transceiver 27 transmits a first output signal 28 generated by the tuned frequency signal generating circuit 26. A sensor 29 and a second transceiver 30 are housed within the second identification marking assembly 22. Such a sensor 29 is calibrated for generating a second output signal 31 when the first output signal 28 is detected as an authorized signal that has a frequency within a pre-determined range. The second transceiver 30 transmits the second output signal 31 to the first transceiver 27.

Again referring to FIG. 5, the distance determining mechanism 25 further includes a transducer 32, and a processor 33 electrically coupled to the transducer 32. A memory 34 is electrically coupled to the processor 33 and includes software instructions, which is essential for causing the first identification marking assembly 21 to determine whether the first and second identification marking assemblies 21, 22 are ten yards apart. Such software instructions execute a control logic algorithm including the steps of determining a total time interval lapsed between transmitting the first output signal 28 to receiving the second output signal 31, multiplying the total time interval with the speed of light for obtaining a first value, comparing the first value with a second value wherein the second value equals ten yards, and if the first and second values are equal, causing the transducer 32 to emit an audible signal for a pre-determined time period.

Figure 7:
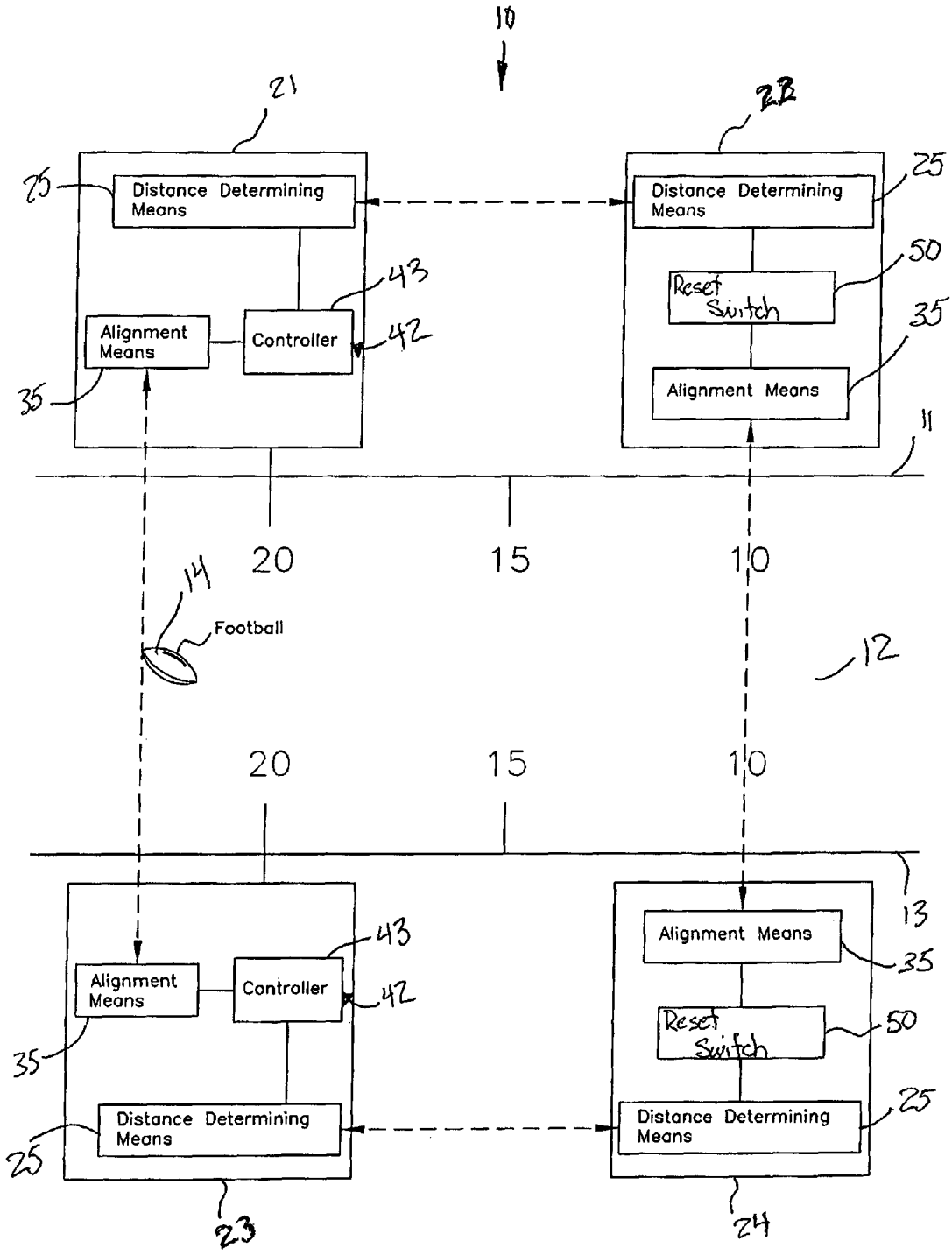
FIG. 7 is a block diagram of the identification marking assemblies positioned on opposite sidelines of a playing field.

Referring to FIG. 7, the system 10 further includes a mechanism 35 for aligning the first and second identification marking assemblies 21, 22 with the third and fourth identification marking assemblies 23, 24 respectively, which is critical such that the second and fourth identification marking assemblies 22, 24 and the first and third identification marking assemblies 21, 23 are horizontally disposed along a single plane and on opposite sides of the playing field 12. This aligning mechanism 35 ensures that the first, second, third and fourth identification assemblies 21, 22, 23, 24 are in the proper position to accurately measure the distance a game ball 14 needs to travel in order to make a first down. In addition, such an aligning mechanism 35 allows an identification marking assembly 21, 22, 23, 24 on one side of the playing field 12 to be moved as necessary, and then realigned, without being improperly positioned. Such an aligning mechanism 35 and the distance determining mechanism 25 are independently and simultaneously operable during game conditions.

Figure 6:
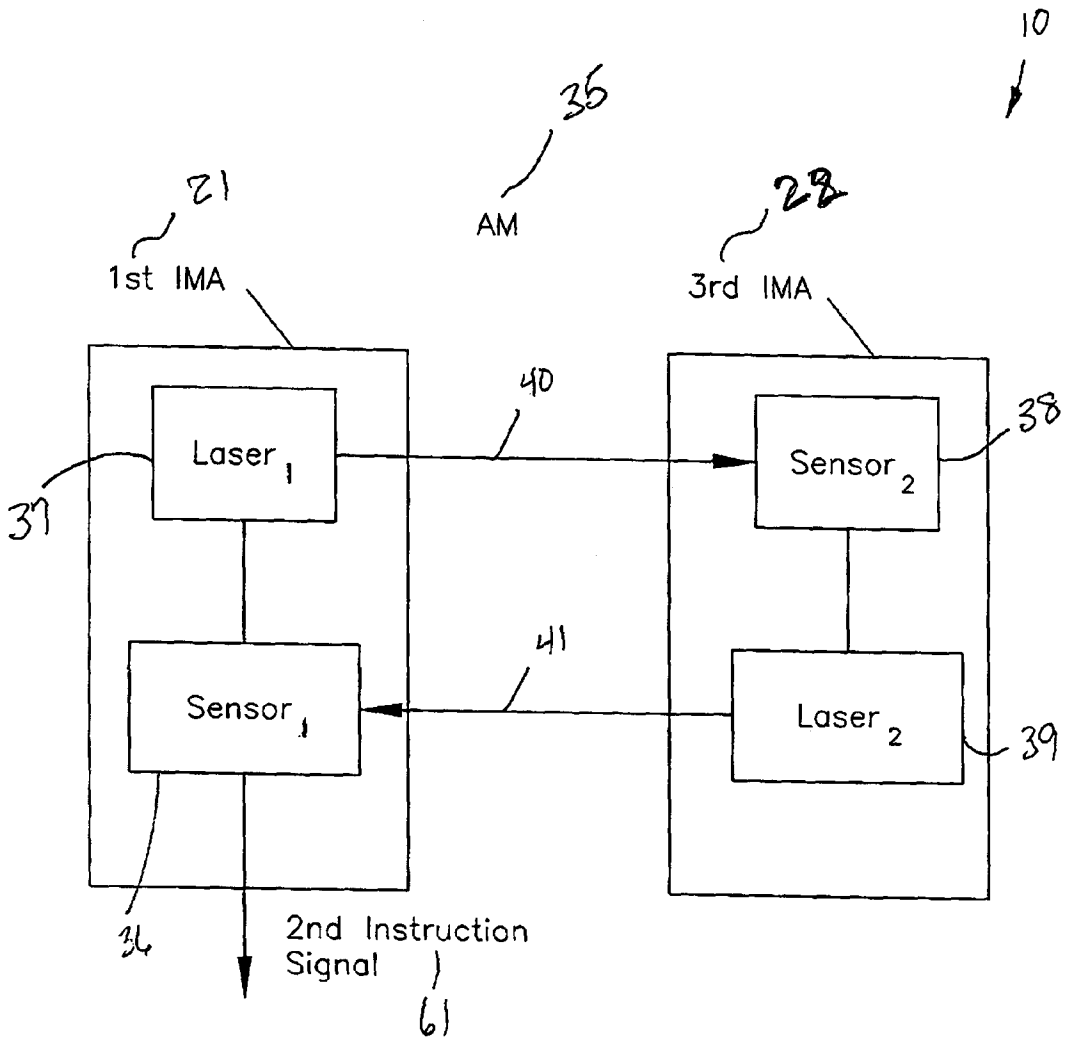
FIG. 6 is a schematic block diagram of the aligning mechanism.

Referring to FIG. 6, such an aligning mechanism 35 includes a first sensor 36 housed within the first identification marking assembly 21, and a first laser 37 housed within the first identification marking assembly 21 and electrically coupled to the first sensor 36. A second sensor 38 is housed within the third identification marking assembly 23. A second laser 39 is housed within the third identification marking assembly 23 and electrically coupled to the second sensor 38. Such a first laser 37 transmits an output signal 40 to the second sensor 38, which is crucial such that the second sensor 38 instructs the second laser 39 to transmit a response signal 41 to the first sensor 36 when the first and third identification marking assemblies 21, 23 are aligned along the plane.

Figure 4:
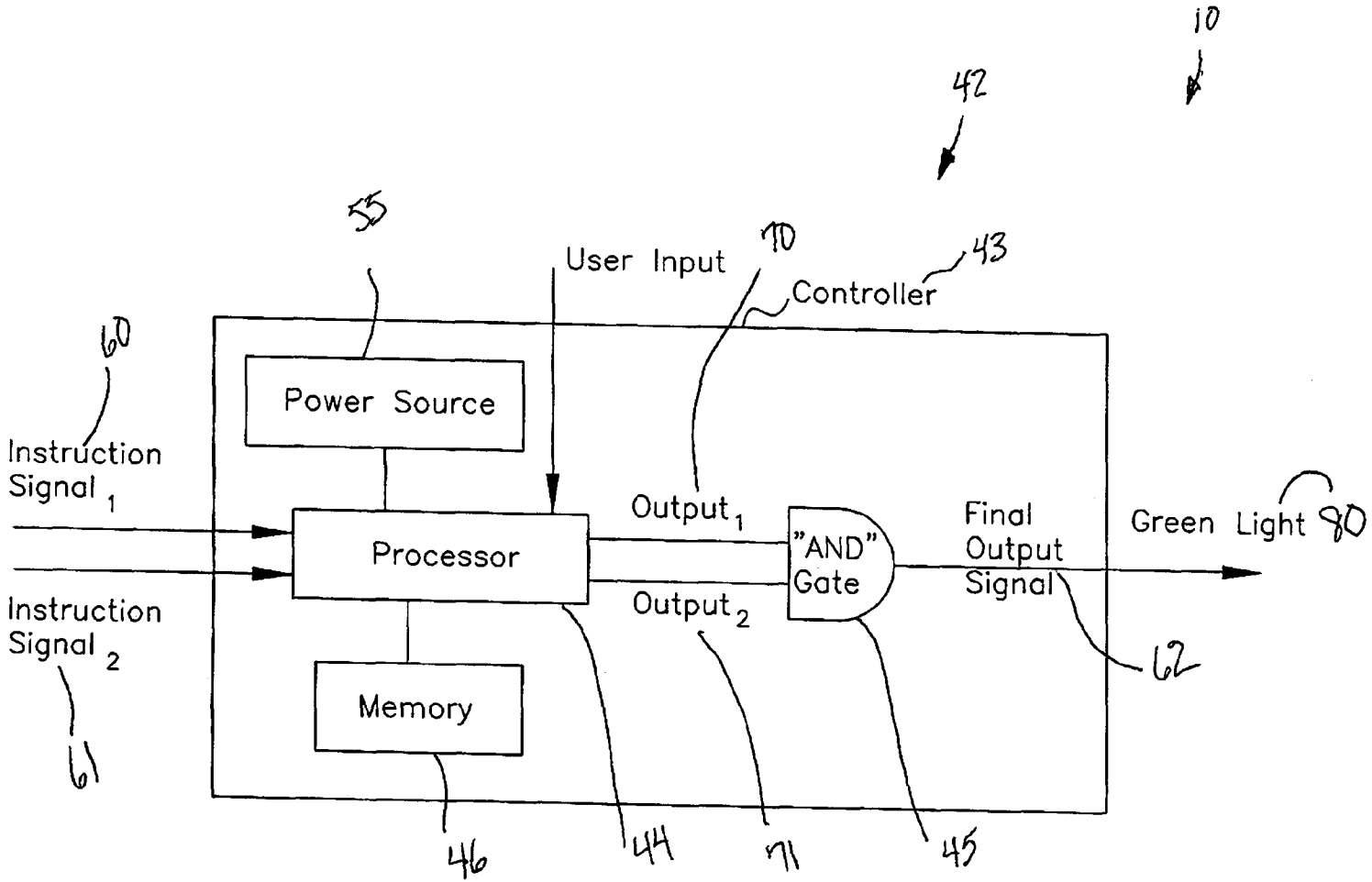
FIG. 4 is a schematic block diagram of the game ball penetrating mechanism.

Referring to FIG. 4, the system 10 further includes a mechanism 42 for determining whether a mobile game ball 14 has penetrated a first down plane defined by the second and fourth identification marking assemblies 22, 24, which is vital such that the official easily determines whether a first down has been achieved. Such a game ball penetrating mechanism 42 includes a controller 43 housed within the second identification marking assembly 22 that includes a processor 44. A logic gate 45, a memory 46, and a power source 55 are electrically coupled to the processor 44.

Again referring to FIG. 4, such a memory 46 includes software instructions that cause the second and fourth identification marking assemblies 22, 24 to establish a green light 80 therebetween when the game ball 14 penetrates the plane defined between the second and fourth identification marking assemblies 22, 24. The green light 80 provides a visual confirmation that the game ball 14 has traveled ten yards and is displayed by the identification marking assemblies 21, 22, 23, 24 in a manner that allows officials, coaches, and spectators to know if a first down has been achieved, thus helping everyone watching the game to feel as if they are a part of the action.

Such software instructions execute a control logic algorithm including the steps of receiving first 60 and second 61 instruction signals from the distance determining mechanism 25 and the alignment mechanism 35 respectively, determining whether the alignment mechanism 35 has been offset beyond a pre-determined time interval, and transmitting first 70 and second 71 output signals to the logic gate 45 based upon data embedded within the first and second instruction signals 60, 61. Such a logic gate 45 generates a final output signal 62 when the first and second output signals 70, 71 have true values, which is important such that the green light 80 remains illuminated until the second and fourth identification marking assemblies 22, 24 are displaced from a rested position. The green light 80 provides a constant measurement while officials and coaches address other matters during a game, and is only extinguished when play is ready to resume.

Figure 2:
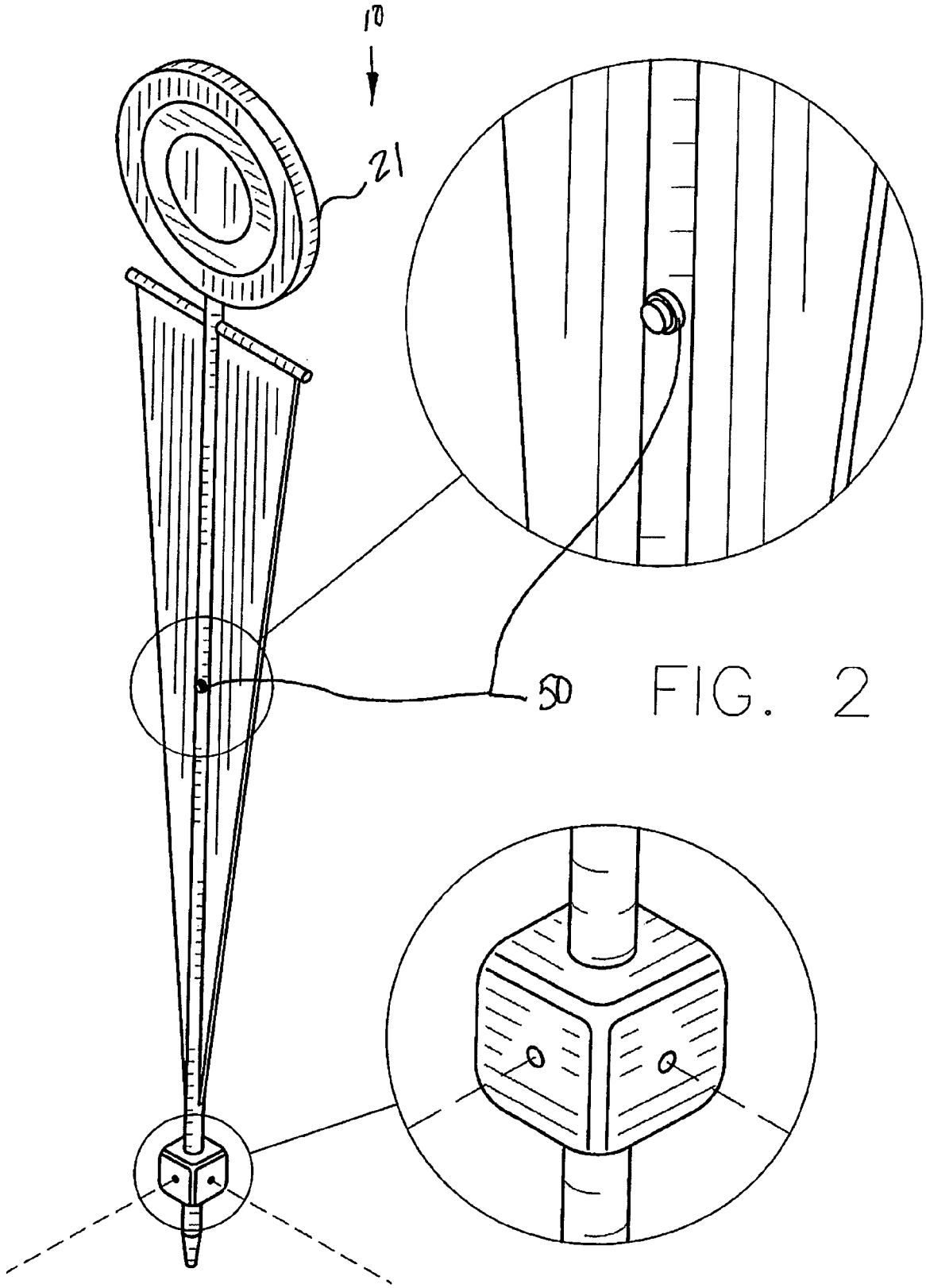
FIG. 2 is a perspective and expanded view of the identification marking assembly shown in FIG. 1, showing an expanded view of the reset switch.
Figure 3:
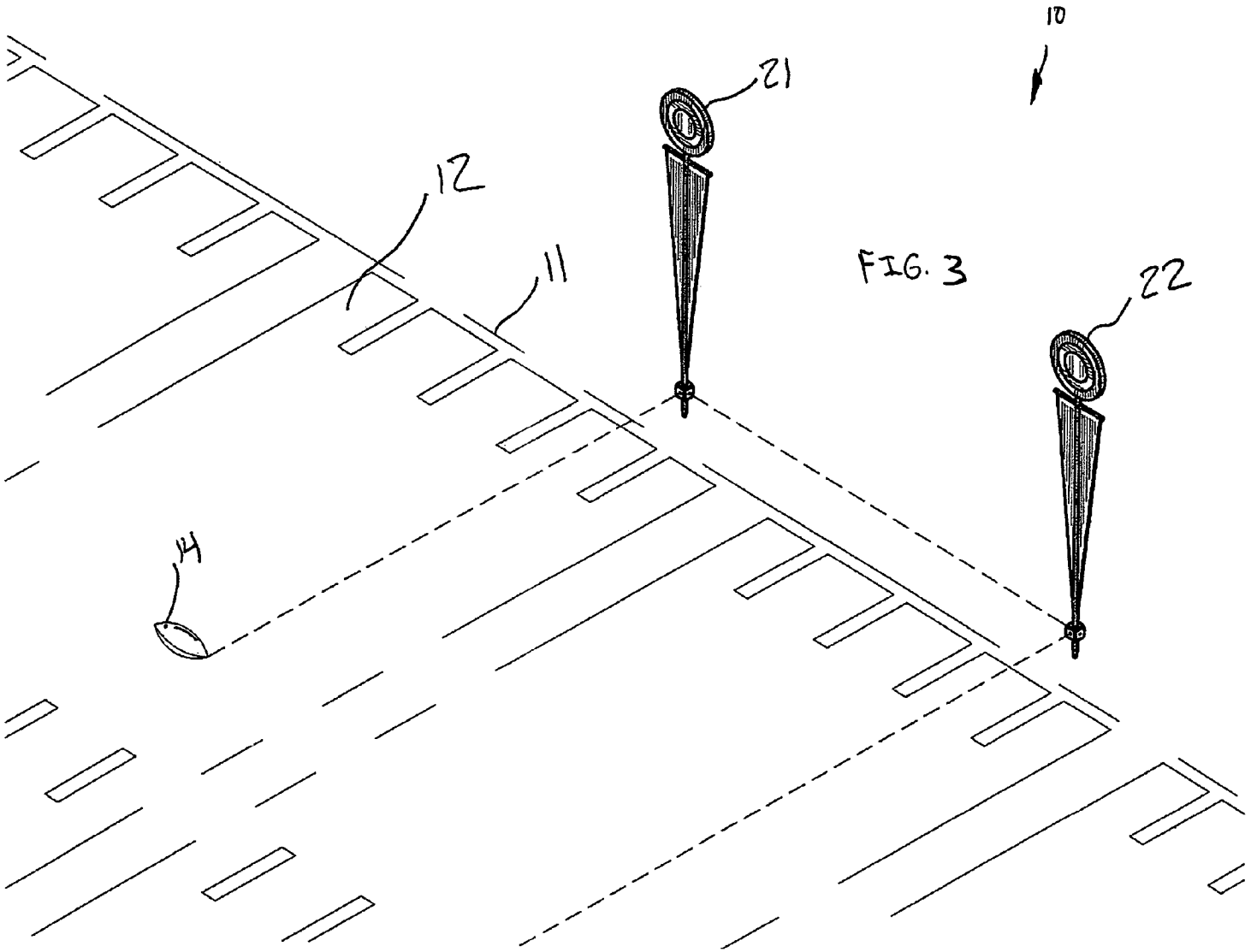
FIG. 3 is a perspective view of the identification marking assemblies positioned on a sideline of a playing field.

Referring to FIGS. 1 and 2, the system 10 further includes a reset switch 50 located on each of the identification marking assemblies, 21, 22, 23, 24. Switch 50 toggles the green light 80 between illuminated and non-illuminated states as desired by the official. The switch 50 allows the official to extinguish the green light 80 when the identification marking assembly 21, 22, 23, 24 is being repositioned, or when the identification marking assembly 21, 22, 23, 24 is not in use.

The ability to remove an identification marking assembly 21, 22, 23, 24 from its initial position without impeding the ability to accurately measure the distance a game ball 14 has moved, along with the game ball penetrating mechanism 42, provides the unexpected benefit of allowing an official to move the identification marking assemblies 21, 22, 23, 24 as game conditions dictate, such as when players exit the field while executing a play, thus avoiding injury to a player or an official, and thereby overcomes prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An electronically actuated first-down marking system for use in sporting activities executed on a pre-defined playing field, said first-down marking system comprising:

first and second identification marking assemblies removably positioned on a first sideline of the playing field;

third and fourth identification marking assemblies removably positioned on a second sideline of the playing field and oppositely seated of said first and second identification marking assemblies respectively;

means for determining a distance between said first and second identification marking assemblies such that a game official can accurately measure ten yards between said first and second identification marking assemblies;

means for aligning said first and second identification marking assemblies with said third and fourth identification marking assemblies respectively such that said second and fourth identification marking assemblies and said first and third identification marking assemblies are horizontally disposed along a single plane and on opposite sides of the playing field; and means for determining whether a mobile game ball has penetrated a first down plane defined by said second and fourth identification marking assemblies such that the official easily determines whether a first down has been achieved;

wherein said distance determining means comprises a tuned frequency signal generating circuit housed within said first identification marking assembly;

a first transceiver electrically coupled to said tuned frequency signal generating circuit, said first transceiver transmitting a first output signal generated by said tuned frequency signal generating circuit;

a sensor housed within said second identification marking assembly;

a second transceiver housed within said second identification marking assembly, said sensor being calibrated for generating a second output signal when said first output signal is detected as an authorized signal having a frequency within a pre-determined range, said second transceiver transmitting said second output signal to said first transceiver;

a transducer;

a processor electrically coupled to said transducer; and a memory electrically coupled to said processor and including software instructions for causing said first identification marking assembly to determine whether said first and second identification marking assemblies are ten yards apart, said software instructions executing a control logic algorithm including the steps of a. determining a total time interval lapsed between transmitting said first output signal to receiving said second output signal, b. multiplying said total time interval with the speed of light for obtaining a first value, c. comparing said first value with a second value wherein said second value equals ten yards, and d. if said first and second values are equal, causing said transducer to emit an audible signal for a pre-determined time period.

2. The first-down marking system of claim 1, wherein said aligning means comprises:

a first sensor housed within said first identification marking assembly;

a first laser housed within said first identification marking assembly and electrically coupled to said first sensor;

a second sensor housed within said third identification marking assembly; and a second laser housed within said third identification marking assembly and electrically coupled to said second sensor, wherein said first laser transmits an output signal to said second sensor such that said second sensor instructs said second laser to transmit a response signal to said first sensor when said first and third identification marking assemblies are aligned along the plane.

3. The first-down marking system of claim 1, wherein said game ball penetrating means comprises:

a controller housed within said second identification marking assembly, said controller comprising a. a processor, b. a logic gate electrically coupled to said processor, and c. a memory electrically coupled to said processor, said memory including software instructions that cause said second and fourth identification marking assemblies to establish a green light between said second and fourth identification marking assemblies when the game ball penetrates the plane defined between said second and fourth identification marking assemblies, said software instructions executing a control logic algorithm including the steps of i. receiving first and second instruction signals from said distance determining means and said alignment means respectively, ii. determining whether said alignment means has been offset beyond a pre-determined time interval, and iii. transmitting first and second output signals to said logic gate based upon data embedded within said first and second instruction signals, wherein said logic gate generates a final output signal when said first and second output signals have true values such that the green light remains illuminated until said second and fourth identification marking assemblies are displaced from a rested position.

4. An electronically actuated first-down marking system for use in sporting activities executed on a pre-defined playing field, said first-down marking system comprising:

first and second identification marking assemblies removably positioned on a first sideline of the playing field;

third and fourth identification marking assemblies removably positioned on a second sideline of the playing field and oppositely seated of said first and second identification marking assemblies respectively, wherein said first, second, third and fourth identification marking assemblies are co-extensively shaped;

means for determining a distance between said first and second identification marking assemblies such that a game official can accurately measure ten yards between said first and second identification marking assemblies;

means for aligning said first and second identification marking assemblies with said third and fourth identification marking assemblies respectively, such that said second and fourth identification marking assemblies and said first and third identification marking assemblies are horizontally disposed along a single plane and on opposite sides of the playing field; and means for determining whether a mobile game ball has penetrated a first down plane defined by said second and fourth identification marking assemblies such that the official easily determines whether a first down has been achieved;

wherein said distance determining means comprises a tuned frequency signal generating circuit housed within said first identification marking assembly;

a first transceiver electrically coupled to said tuned frequency signal generating circuit, said first transceiver transmitting a first output signal generated by said tuned frequency signal generating circuit;

a sensor housed within said second identification marking assembly;

a second transceiver housed within said second identification marking assembly, said sensor being calibrated for generating a second output signal when said first output signal is detected as an authorized signal having a frequency within a pre-determined range, said second transceiver transmitting said second output signal to said first transceiver;

a transducer;

a processor electrically coupled to said transducer; and a memory electrically coupled to said processor and including software instructions for causing said first identification marking assembly to determine whether said first and second identification marking assemblies are ten yards apart, said software instructions executing a control logic algorithm including the steps of;

a. determining a total time interval lapsed between transmitting said first output signal to receiving said second output signal, b. multiplying said total time interval with the speed of light for obtaining a first value, c. comparing said first value with a second value, wherein said second value equals ten yards, and d. if said first and second values are equal, causing said transducer to emit an audible signal for a pre-determined time period.

5. The first-down marking system of claim 4, wherein said aligning means comprises:

a first sensor housed within said first identification marking assembly;

a first laser housed within said first identification marking assembly and electrically coupled to said first sensor;

a second sensor housed within said third identification marking assembly; and a second laser housed within said third identification marking assembly and electrically coupled to said second sensor, wherein said first laser transmits an output signal to said second sensor such that said second sensor instructs said second laser to transmit a response signal to said first sensor when said first and third identification marking assemblies are aligned along the plane.

6. The first-down marking system of claim 4, wherein said game ball penetrating means comprises:

a controller housed within said second identification marking assembly, said controller comprising:

a. a processor;

b. a logic gate electrically coupled to said processor; and c. a memory electrically coupled to said processor, said memory including software instructions that cause said second and fourth identification marking assemblies to establish a green light between said second and fourth identification marking assemblies when the game ball penetrates the plane defined therebetween, said software instructions executing a control logic algorithm including the steps of;

i. receiving first and second instruction signals from said distance determining means and said alignment means respectively, ii. determining whether said alignment means has been offset beyond a pre-determined time interval, and iii. transmitting first and second output signals to said logic gate based upon data embedded within said first and second instruction signals, wherein said logic gate generates a final output signal when said first and second output signals have true values such that the green light remains illuminated until said second and fourth identification marking assemblies are displaced from a rested position.

7. An electronically actuated first-down marking system for use in sporting activities executed on a pre-defined playing field, said first-down marking system comprising:

first and second identification marking assemblies removably positioned on a first sideline of the playing field;

third and fourth identification marking assemblies removably positioned on a second sideline of the playing field and oppositely seated of said first and second identification marking assemblies respectively, wherein said first, second, third and fourth identification marking assemblies are co-extensively shaped;

means for determining a distance between said first and second identification marking assemblies such that a game official can accurately measure ten yards between said first and second identification marking assemblies;

means for aligning said first and second identification marking assemblies with said third and fourth identification marking assemblies respectively, such that said second and fourth identification marking assemblies and said first and third identification marking assemblies are horizontally disposed along a single plane and on opposite sides of the playing field, wherein said distance determining means and said aligning means are independently and simultaneously operable during game conditions; and means for determining whether a mobile game ball has penetrated a first down plane defined by said second and fourth identification marking assemblies such that the official easily determines whether a first down has been achieved;

wherein said distance determining means comprises:

a tuned frequency signal generating circuit housed within said first identification marking assembly;

a first transceiver electrically coupled to said tuned frequency signal generating circuit, said first transceiver transmitting a first output signal generated by said tuned frequency signal generating circuit;

a sensor housed within said second identification marking assembly;

a second transceiver housed within said second identification marking assembly, said sensor being calibrated for generating a second output signal when said first output signal is detected as an authorized signal having a frequency within a pre-determined range, said second transceiver transmitting said second output signal to said first transceiver;

a transducer;

a processor electrically coupled to said transducer; and a memory electrically coupled to said processor and including software instructions for causing said first identification marking assembly to determine whether said first and second identification marking assemblies are ten yards apart, said software instructions executing a control logic algorithm including the steps of;

a. determining a total time interval lapsed between transmitting said first output signal to receiving said second output signal, b. multiplying said total time interval with the speed of light for obtaining a first value, c. comparing said first value with a second value, wherein said second value equals ten yards, and d. if said first and second values are equal, causing said transducer to emit an audible signal for a pre-determined time period.

8. The first-down marking system of claim 7, wherein said aligning means comprises:

a first sensor housed within said first identification marking assembly;

a first laser housed within said first identification marking assembly and electrically coupled to said first sensor;

a second sensor housed within said third identification marking assembly; and a second laser housed within said third identification marking assembly and electrically coupled to said second sensor, wherein said first laser transmits an output signal to said second sensor such that said second sensor instructs said second laser to transmit a response signal to said first sensor when said first and third identification marking assemblies are aligned along the plane.

9. The first-down marking system of claim 7, wherein said game ball penetrating means comprises:

a controller housed within said second identification marking assembly, said controller comprising:

a. a processor;

b. a logic gate electrically coupled to said processor; and c. a memory electrically coupled to said processor, said memory including software instructions that cause said second and fourth identification marking assemblies to establish a green light between said second and fourth identification marking assemblies when the game ball penetrates the plane defined therebetween, said software instructions executing a control logic algorithm including the steps of;

i. receiving first and second instruction signals from said distance determining means and said alignment means respectively, ii. determining whether said alignment means has been offset beyond a pre-determined time interval, and iii. transmitting first and second output signals to said logic gate based upon data embedded within said first and second instruction signals, wherein said logic gate generates a final output signal when said first and second output signals have true values such that the green light remains illuminated until said second and fourth identification marking assemblies are displaced from a rested position.

* * * * *